United States Patent [19]

Vizecky

[11] Patent Number: 4,516,460

[45] Date of Patent: May 14, 1985

[54] METHOD AND APPARATUS FOR SLITTING SHOTGUN SHELL WADS

[75] Inventor: Donald F. Vizecky, Minneapolis, Minn.

[73] Assignee: Steel Handlers' Manual and Steel Handloaders' Components, Inc., Minneapolis, Minn.

[21] Appl. No.: 415,154

[22] Filed: Sep. 7, 1982

[51] Int. Cl.[3] ..... B26D 3/12; B26D 5/10; F42B 33/00

[52] U.S. Cl. ..... 83/861; 83/54; 83/191; 83/620; 83/23; 30/302; 30/303

[58] Field of Search ..... 83/620, 861, 54, 191, 83/880, 875, 180, 184; 30/92.5, 302, 303; 86/23, 29, 30

[56] References Cited

U.S. PATENT DOCUMENTS

| | | | |
|---|---|---|---|
| 496,809 | 5/1893 | Allen | 30/303 |
| 975,410 | 11/1910 | Fullmer et al. | 30/302 |
| 2,251,587 | 8/1941 | Gagner | 30/303 |
| 3,059,515 | 10/1962 | Lindsey . | |
| 3,069,951 | 12/1962 | Bares | 83/184 |
| 3,153,360 | 10/1964 | Coulon | 83/191 |
| 3,715,941 | 2/1973 | Andrews et al. . | |
| 3,788,224 | 1/1974 | Merritt | 102/42 |
| 4,103,621 | 8/1978 | Fackler | 102/95 |

FOREIGN PATENT DOCUMENTS

| | | | |
|---|---|---|---|
| 463874 | 6/1951 | Italy | 30/302 |

OTHER PUBLICATIONS

Pamphlet—"100 10 Gauge Magnum Ballistic Pattern Drivers", Ballistic Products Inc., Wayazata, MN.

Pamphlet—"10 Gauge Magnum Ballistic Pattern Drivers", Ballistic Products Inc., Wayazata, MN.

Booklet—"Shotshell Reloading with the Versamec 700", Mayville Engineering Company, Inc., Mayville, WI.

*Primary Examiner*—Donald R. Schran

*Attorney, Agent, or Firm*—Kinney & Lange

[57] ABSTRACT

The present invention relates to a method and apparatus for cutting a series of uniformly spaced longitudinal slits in a cylindrical shotgun shell wad. The wad slitting apparatus, with which the method can be performed, is a cylindrical member having upper and lower portions. A plurality of cutting members are uniformly spaced about the lower portion and project radially outwardly therefrom, with each cutting member having a downwardly facing cutting edge spaced a predetermined distance from a bottom edge of the cylindrical member. In use, the upper portion of the cylindrical member is secured to a movable ram member, which may be the ram tube of a shotgun reloader, and the lower portion is inserted into a wad positioned on a fixed plate. The ram member is then moved toward the plate, causing the cutting members to make a plurality of longitudinal slits in the wad with the slits extending from the upper end of the wad to an area spaced from a lower base portion of the wad by said predetermined distance.

7 Claims, 9 Drawing Figures

METHOD AND APPARATUS FOR SLITTING SHOTGUN SHELL WADS

BACKGROUND OF THE INVENTION

1. Field of the Invention.

The present invention relates to shotgun shell loading and reloading, and particularly to a method and apparatus for slitting cylindrical shotgun shell wads.

2. Description of the Prior Art.

In recent times, the interest in low volume devices for recharging and reloading shotgun shells has greatly increased. Numerous shell reloaders are available to hand loaders, such as the Versamec 700 Shotgun Shell Reloader manufactured by the Mayville Engineering Company, Inc. of Mayville, Wis. With such devices, a used shotgun shell casing can be refitted with a new shot charge and shot load for reuse.

Historically, the shot or "buckshot" found in shotgun shells has consisted essentially of lead pellets. However, because of environmental concerns related to lead poisoning of wildlife, the use of lead shot has become somewhat restricted, causing hunters and sportsmen to substitute steel shot in place of lead. Steel shot is much harder than lead and can cause scratching of the interior surfaces of a shotgun barrel when fired. To counteract this problem, cylindrically shaped "wards" have been designed for insertion within the casing of the shotgun shell for holding the shot prior to firing. Typically, a wad is formed of a lightweight plastic material which can contain the shot while in the barrel but does not scratch the barrel as it passes through. When a shell containing a wad is fired, the wad and shot travel together along the barrel of the shotgun thus keeping the shot from contacting the barrel. After the wad and shot exit the shotgun, the wad falls harmlessly to the ground while the shot continues on to the desired target.

Examples of such wads or wad columns for shotgun shells are shown and discussed in U.S. Pat. No. 3,788,224, granted to Merritt on Jan. 29, 1974, U.S. Pat. No. 4,103,621, granted to Fackler on Aug. 1, 1978, and brochures distributed by Ballistic Products, Inc. of Wayzata, Minn. entitled "10 Gauge Magnum Ballistic Pattern Drivers" and "100 10 Gauge Magnum Ballistic Pattern Drivers". Not only do such shotgun wads protect the interior of the shotgun barrel from scratching, but they also provide a means for sealing the charged powder gases behind the shot load in the shell and a means for producing a uniform and long-range pattern for the shot upon firing.

The pattern produced by a certain shot load depends, to a certain extent, on the form of the wad. The cylindrical walls of the wad must be slit to allow the wad to separate cleanly from the shot upon exiting the barrel of the shotgun. If not slit, the wad and shot can become a dangerous plastic encased "slug" emerging from the shotgun barrel which could seriously injure a fellow hunter or damage property. To prevent this, and to obtain a uniform pattern, the slits must be equally spaced radially about the wad so that the "petals" formed by the slits in the cylindrical wad are identical in size and shape. Thus, as the wad containing shot leaves the shotgun barrel, the air catches the edges of the petals causing them to fold out so that the wad drops away and the shot goes on to its target. Uniform spacing of the slits allows the shot to separate from the wad clearly and limits wad interference with the trajectory and pattern of the shot.

Wads incorporated into shotgun shells produced in high volume facilities are slit by expensive high volume cutting machines. The reloading or recharging of shotgun shells is usually a low volume process, usually done by hand. Wads are often supplied to handloaders in an unslit form so that they may be slit as desired. A sharp knife or scissors is used to slit the wads and the slitting is done by eye, so that uniformity and clean straight slits are not always attained. In addition, the use of a sharp knife in such a manner presents certain safety problems.

Although not specifically related to the slitting of wads for shotgun shells, devices for slitting or slotting the ends of cylindrical members are shown in several U.S. patents. U.S. Pat. No. 3,715,941, granted to Andrews et al on Feb. 2, 1973 shows an arrangement for making a plurality of slits through the whole length of a tube of insulating material. U.S. Pat. No. 3,153,360, granted to Coulon on Oct. 20, 1964 shows an arrangement which goes into a power press and is used to press a punch element with cutting edges in the end of the tube to form a slot. U.S. Pat. No. 3,069,951, granted to Bares on Dec. 25, 1962 discloses a cutting tool used to produce two slits in the end of a central tube for partitioning the walls of multiple tube hoses. U.S. Pat. No. 3,059,515, granted to Lindsey on Oct. 23, 1962 shows a device for cutting grooves which do not go all the way through the wall of a tube or workpiece for the purpose of providing a means to remove shavings generated during the machining of the workpiece. While the devices of these patents are directed to the slitting or grooving of various workpieces, none of them are directed in function to the unique constraints and problems involved in slitting shotgun shell wads.

SUMMARY OF THE INVENTION

The apparatus and method of the wad slitter of the present invention overcome the disadvantages and problems of uniformly slitting shotgun shell wads for low volume shell reloading operations. The wad slitting apparatus, with which the method can be performed, is simple of design and manufacture, as well as being inexpensive and easily adaptable to hand operated shotgun shell reloading devices.

The present invention relates to an apparatus and method for causing a series of uniformly spaced longitudinal cuts in a cylindrical shotgun shell wad. In its apparatus form, the invention comprises a cylindrical member having an upper portion and a lower portion, with the upper portion being designed to be secured to a ram member movable with respect to a fixed plate, such as those ram tubes and fixed plates found on typical shotgun shell reloading devices. A plurality of cutting members are uniformly spaced about the lower portion of the cylindrical member and project radially outwardly therefrom. Each of the cutting members has a downwardly facing cutting edge spaced from a bottom edge of the cylindrical member a predetermined distance. In operation, the upper portion of the cylindrical member is secured to the ram member and the lower portion of the cylindrical member is inserted into a wad positioned on the fixed plate. The ram member is then moved toward the plates so that the cutting members of the cylindrical member make a plurality of longitudinal cuts in the wad with the cuts extending from the top end of the wad to an area spaced from the bottom end of the wad by said predetermined distance.

The method of slitting cylindrical wads for use in reloading shotgun shells of the present invention comprises providing a cylindrical member as described above, securing the upper portion of the cylindrical member to the ram member of the shotgun shell reloader, placing the wad on the fixed plate portion of the shotgun shell reloader, moving the ram member toward the fixed plate portion so that the lower portion of the cylindrical member enters the wad and continually moving the ram member until the bottom edge thereof engages a lower base portion of the wad so that the cutting members cut a plurality of longitudinal cuts from the top end of the wad to an area spaced from the base portion of the wad by the predetermined distance, raising the ram member and ejecting the severed wad from the cylindrical member.

Preferably, the ram member is a hollow tube, and along with the fixed plate, comprise portions of a shotgun shell reloading device. The upper portion of the cylindrical member is designed to fit within and be secured to the hollow ram member. The lower portion of the cylindrical member has a plurality of slots therein with the cutting members secured within said slots. The cutting members are equally spaced apart radially about the lower portion of the cylindrical member, and preferably, there are four cutting members equally spaced 90° from the adjacent cutting members. An apertured member is disposed in the path of the wad as the ram member is raised so as to engage the top end of the wad to force it off of the cylindrical member after it has been severed.

FIG. *2a* is a pictorial exploded view of the cutting members of the wad slitting apparatus of the present invention.

Figure 3:
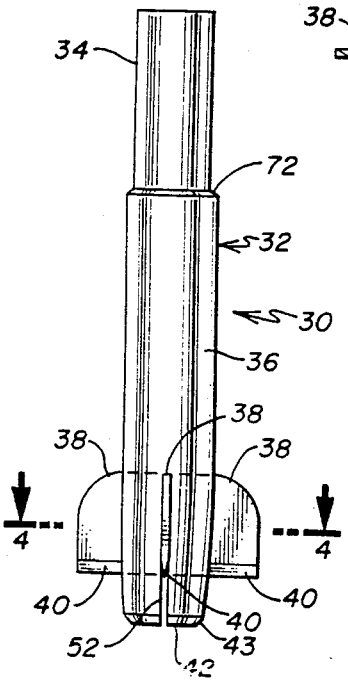

FIG. 3 is an elevational side view of the wad slitting apparatus of the present invention.

Figure 4:
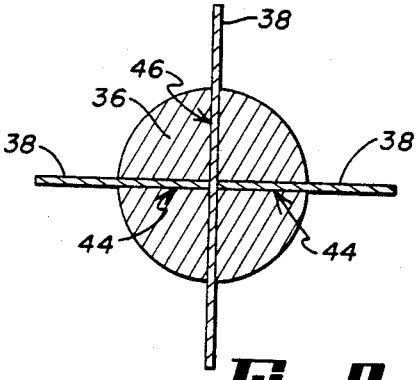

FIG. 4 is an enlarged sectional view as taken along line 4—4 in FIG. 3.

Figure 5:
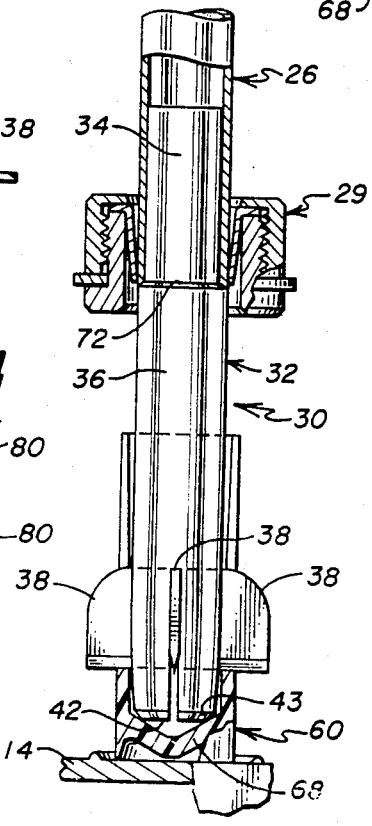

FIG. 5 is a pictorial view of a shotgun shell wad.

Figure 6:
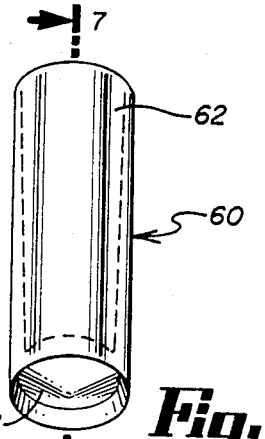
Figure 2A:
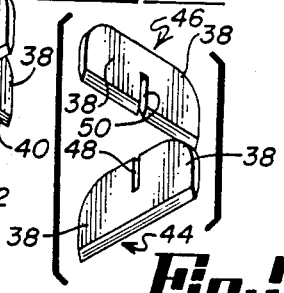

FIG. 6 is a sectional view as taken along line 6—6 in FIG. 5.

Figure 7:
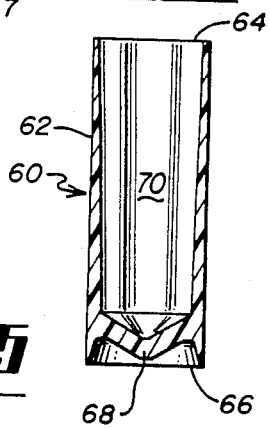

FIG. 7 is a side elevational view of the wad slitter apparatus of the present invention in operation on a shotgun shell reloader, with some parts shown in section.

Figure 8:
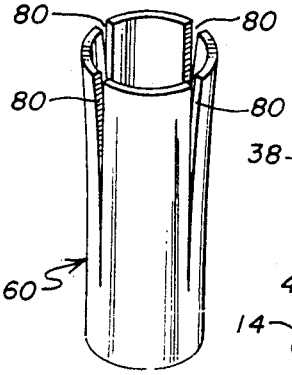

FIG. 8 is a pictorial view of a shotgun shell wad after being cut by the wad slitting apparatus and method of the present invention.

DETAILED DESCRIPTION OF THE PREFERRED EMBODIMENT

Figure 1:
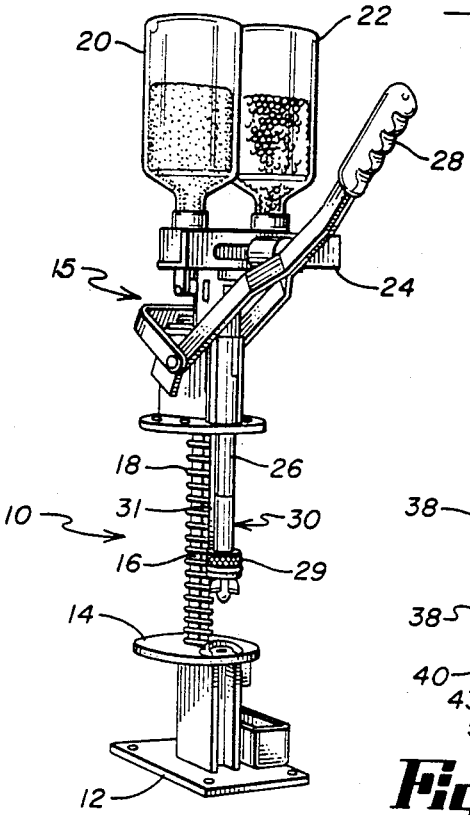
FIG. 1 is a perspective view of a shotgun shell reloader device having the wad slitting apparatus of the present invention secured to its movable ram member.

A typical low volume shotgun shell reloader device 10 is shown in FIG. 1. The shell reloader 10 is used for the hand reloading of used shotgun shell casings with new charge powder and shot pellets or "buckshot." The shell reloader 10 has a base 12 upon which is mounted a fixed workpiece plate 14. A loading assembly 15 is vertically slidably mounted on a fixed post 16 which extends upwardly from the fixed plate 14. The loading assembly 15 is biased upwardly and away from the fixed plate 14 by a spring means 18, as shown.

Mounted on the loading assembly 15 adjacent the top of the shell reloader 10 are reservoirs for the charge powder and shot, such as shot container 22 and powder container 20. These containers have openings at their bottom ends and are mounted on a movable charging bar 24, the position of which determines whether powder or shot is discharged by the shell loader 10 into a shotgun shell casing. The powder and shot are dropped from their containers into the shell casing through a ram member 26 which is typically a hollow tube having a lower open end. The charging bar 24 and ram member 26 are both mounted on the loading assembly 15 and move with said loading assembly 15 when it is slidably moved vertically with respect to the fixed plate 14. As shown in FIG. 1, an apertured member or wad guide 29 is secured to a top end of the fixed post 16 by a mounting plate 31 and positioned below the ram member 26.

Vertical movement of the loading assembly 15 is actuated by depressing a charging handle 28 which is pivotally mounted to the fixed post 18 and loading assembly 15. To reload a shotgun shell casing that has already been provided with a new primer, the casing (not shown) is first placed on the fixed plate 14 directly under the ram member 26. The charging handle 28 is then depressed which moves the ram member 26 toward the fixed plate 14 and into an open upper end of the casing. The charging bar 24 is then moved to dispense either powder or charge into the casing as desired. When the pressure on the charging handle is released, the spring means 18 forces the loading assembly 15 (and ram member 26 mounted thereon) upwardly and away from the fixed plate 14 to the position shown in FIG. 1.

In FIG. 1, a wad slitting apparatus 30 of the present invention is shown positioned for use on the ram member 26 of the shell reloader 10. The wad slitting apparatus 30 is more fully shown in a pictorial view in FIG. 2. The apparatus 30 comprises a cylindrical member 32 having an upper portion 34 and a lower portion 36. A plurality of cutting members 38 are uniformly spaced about the lower portion 36 and project radially outwardly therefrom. Each of the cutting members 38 has a downwardly facing cutting edge 40 spaced from a bottom edge 42 of the cylindrical member 32 by a predetermined distance, as best shown in FIG. 3.

Any number of cutting members may be used, as long as they are all equally spaced radially apart about the lower portion 36 of the cylindrical member 32. Preferably, there are four cutting members 38 each spaced 90° from adjacent cutting members, as shown in FIG. 4. In this embodiment, the four cutting members are comprised of two interlocking blade members 44 and 46, as shown in FIG. *2a*. The blade members 44 and 46 have notches 48 and 50, respectively. Notch 48 extends downward from the top edge of blade 44 and notch 50 extends upward from the bottom edge of blade 46 to permit the blades to interlock in the crossed configuration shown in FIG. 4.

Figure 2:
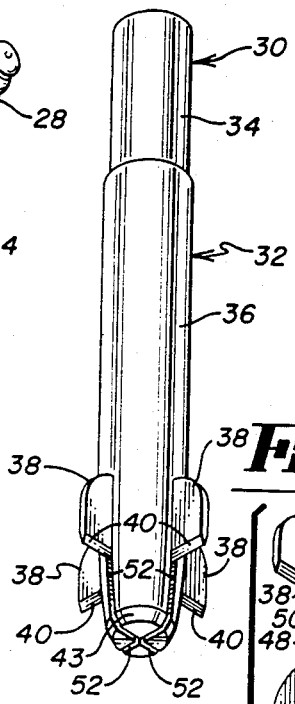
FIG. 2 is a perspective pictorial view of the wad slitting apparatus of the present invention.

As best shown in FIGS. 2 and 3, the lower portion 36 of the cutting member 32 has a plurality of slits 52 therein for acceptance of the blade members 44 and 46. For assembly, the blade members 44 and 46 are inserted in their crossed configuration into the slits 52 (to position as shown in FIG. 2) and secured in place by suitable fastening means, such as high strength glue or epoxy adhesive.

As shown, the upper portion 34 of the cylindrical member 32 is smaller in diameter than the lower portion 36. The upper portion 34 is designed to fit within the lower open end of the hollow tube ram member 26 on the shell reloader 10, as shown in FIG. 5. The cylindrical members 32 has an annular shoulder portion 72 which abuts the lower end of the ram member 26 when the upper portion 34 is inserted therein. FIG. 1 shows the wad slitting apparatus 30 inserted into the ram member 26 and ready to be moved toward the fixed plate 14 to slit a shotgun shell wad.

A typical cylindrical shotgun shell wad is shown in FIGS. 6 and 7. Typically, such shotgun shell wads 60 are made of resilient molded plastic. Each wad 60 has a generally cylindrical peripherial cup wall 62 which is open at its top end 64 and sealably closed at its bottom end 66 by a lower base portion 68. A chamber 70 is formed within the peripheral wall 62 for acceptance of the shot or "buckshot" of the shotgun shell when reloaded. In addition, the chamber 70 can hold shock absorption means, such as cardboard inserts (not shown), to form air pockets in the chamber 70 and reduce the pressure upon the shot when the recharged shotgun shell is fired.

In using the wad slitter apparatus 30 of the present invention to perform the method for slitting shotgun shell wads, the upper portion 34 of the cylindrical member 32 is first secured to the ram member 26 of a shotgun shell reloader. The upper portion 34 is inserted into the hollow ram member 26 to the position shown in FIG. 1. A wad cutting cycle is is begun by placing a wad 60 in position on the fixed plate 14 of the shell reloader 10 so that the open top end 64 of the wad 60 is facing upwardly and immediately below the cylindrical member 32. The ram member 26 is then moved toward the fixed plate 14 so that the lower portion 36 of the cylindrical member 32 enters the wad 60. As best shown in FIGS. 2 and 3, the bottom edge 42 of the lower portion 36 of the cylindrical member 32 has an annular chamfered or tapered portion 43 to aid in guiding the cylindrical member 32 into the open top end 64 of a wad 60. Once the lower portion 36 has entered the wad 60, the ram member 26 is continually moved downwardly until the bottom edge 42 thereof engages the lower base portion 68 of the wad 60. During said movement, the cutting members 38 cut a plurality of longitudinal cuts 80 from the top end 64 of the wad 60 to an area spaced from the base portion 68 of the wad 60 by said predetermined distance. In FIG. 5, the cylindrical member 32 is shown at its lowermost position during the cutting cycle after the longitudinal cuts 80 have been placed in the wad 60.

To complete a cutting cycle, the ram member 26 is raised to eject the severed wad 60 from the cylindrical member 32. This ejection is accomplished by use of the wad guide 29 which is disposed in the path of the wad 60 as the ram member 26 is raised. The severed wad 60 is carried with the ram member 26 and cylindrical member 32 as they are raised upwardly until the now-severed top end 64 of the wad 60 engages the bottom of the wad guide 29, which causes the wad 60 to peel off of the cylindrical member 32 as it is continually raised relative to the wad guide 29. The severed wad 60 (shown in FIG. 8) is removed from the work place and a new unsevered wad 60 (shown in FIGS. 6 and 7) is placed on the fixed plate 14 for a new cutting cycle. The wad 60 shown in FIG. 8 is now provided with a series of uniformly spaced longitudinal cuts 80 and is ready for loading in a shotgun shell casing.

CONCLUSION

The present invention provides an apparatus and method for cutting a plurality of uniformly spaced slits in a cylindrical shotgun shell wad. The use of the present invention in conjunction with a typical low volume shotgun shell reloader device results in severed wads of much better quality than those achieved using prior art low volume wad cutting methods. The present invention is simple, easy to use, safe and provides an inexpensive yet valuable addition to a typical low volume shotgun shell reloader.

Although the present invention has been described with reference to preferred embodiments, workers skilled in the art will recognize that changes may be made in form and detail without departing from the spirit and scope of the invention.

What is claimed is:

1. In combination with a shotgun shell reloading device which has a fixed plate and a ram member movable with respect to the fixed plate, and where a portion of the ram member is a hollow tube having an open end adjacent the fixed plate, an apparatus for causing a series of uniformly spaced longitudinal cuts of the same length through a cylindrical peripheral cup wall of a plastic shotgun shell wad, said apparatus comprising:

a cylindrical member having an upper end portion and a lower portion, the diameter of the upper end portion being less than that of the lower end portion with a shoulder therebetween;

said upper portion of reduced diameter being designed to be secured within the open end of the hollow tube of the ram member with said shoulder engaging the lower end of the hollow tube; and said lower portion having a plurality of cutting blades uniformly spaced about the lower portion and projecting radially outwardly therefrom, each of said cutting blades having a downwardly facing cutting edge spaced from a bottom edge of said cylindrical member the same predetermined distance, so that when the cylindrical member is secured to the hollow tube of the ram member, the lower portion thereof is inserted into a top open end of a cylindrical cup wall of a plastic shotgun shell wad positioned on the fixed shotgun shell wad positioned on the fixed plate of the shotgun shell reloading device, and the ram member is moved toward the fixed plate, the cup wall of the wad has a plurality of longitudinal slits of equal length made therethrough by cutting blades, the lower end of said cylindrical member being chamfered to facilitate entry of the lower portion of said cylindrical member into the cup wall of the wad; and means for limiting downward movement of the cylindrical member so that the longitudinal slits extend from the top end of the wad to an area spaced from a lower base portion of the wad by a predetermined distance.

2. The apparatus of claim 1 wherein the lower portion of the cylindrical member has a plurality of uniformly spaced longitudinal slits therein extending from the bottom edge thereof an equal distance toward the top end thereof, and the cutting blades are secured within said slits.

3. The apparatus of claim 1 wherein there are four cutting blades each spaced ninety degrees from the adjacent cutting blades.

4. The apparatus of claim 1 in which the downwardly facing cutting edges are spaced from the bottom edge of the cylindrical member by the desired predetermined distance between the bottom of the slits and the lower base portion of the wad, the portion of the cylindrical member beneath the cutting edges constituting the means for limiting downward movement of the cylindrical member.

5. A method of creating a plurality of longitudinally parallel slits of equal length through the cylindrical cup wall of a cylindrical plastic shotgun shell wad used in reloading shotgun shells which comprises the steps of:

securing a generally cylindrical cutting member to a movable tubular ram member of a shotgun shell reloader, said cutting member having a plurality of cutting blades uniformly spaced about a lower portion thereof and projecting radially outwardly therefrom with the cutting edges of the blades disposed downwardly and all uniformly spaced from the bottom of the cutting member;

axially aligning a plastic shotgun shell wad with respect to the cutting member of the ram member, said wad having a cylindrical cup wall and a closed lower wall;

fixing the axial position of the wad with respect to the ram member by placing the bottom of the wall on a fixed base;

moving the ram member in a direction toward the stationary wad so that the cutting blades engage the cup wall of the wad;

producing a plurality of longitudinal slits of equal length through the cylindrical cap wall of the wad by continuing to move the ram member in the same direction;

positively stopping the movement of the cutting edges when they are spaced a predetermined distance from the lower wall of the wad;

moving the ram member in the opposite direction with respect to the wad; and removing the slit wad from the cutting member.

6. The method of claim 8 wherein the shotgun shell reloader is provided with an apertured member disposed in the path of the wad as the ram member is raised so as to engage the top of the severed wad to force it off of the cylindrical member.

7. The method of claim 5 in which the cutting edges of the blades are spaced from the bottom of the cylindrical member by a distance equal to the desired distance between the bottom of the slits and the lower wall of the wad and in which the movement of the cutting edges is stopped by engaging the bottom of the cylindrical member with the lower wall of the wad.

* * * * *